US007311342B1

(12) United States Patent
Fan

(10) Patent No.: US 7,311,342 B1
(45) Date of Patent: Dec. 25, 2007

(54) LOCK DEVICE

(75) Inventor: Fang-Chang Fan, Chia-Yi (TW)

(73) Assignee: Eversafety Precision Industry (Tianjin) Co., Ltd., Tianjin (CN)

( * ) Notice: Subject to any disclaimer, the term of this patent is extended or adjusted under 35 U.S.C. 154(b) by 0 days.

(21) Appl. No.: 11/732,262

(22) Filed: Apr. 3, 2007

(51) Int. Cl.
*E05B 3/00* (2006.01)

(52) U.S. Cl. ..... 292/336.3; 292/DIG. 64; 292/357

(58) Field of Classification Search ..... 292/336.3, 292/357, DIG. 64
See application file for complete search history.

(56) References Cited

U.S. PATENT DOCUMENTS 4,037,865 A * 7/1977 Hook ..... 292/357
5,727,406 A * 3/1998 Banducci ..... 70/224
6,264,255 B1 * 7/2001 Fortune ..... 292/336.3
6,616,203 B1 * 9/2003 Lenk et al. ..... 292/336.3
6,745,602 B2 * 6/2004 Nakasone et al. ..... 70/224

* cited by examiner

*Primary Examiner*—Gary Estremsky
(74) *Attorney, Agent, or Firm*—Jackson Walker, LLP

(57) ABSTRACT

A lock device includes an external cylinder body, a latch unit, a screw part and an inner lock body that are combined together. The inner lock body has an inner cover plate set, a washer plate, a spring, a spring plate, an inner connecting plate and an inner lever handle. A pair of opposite openings is located at a periphery of the inner cover plate set. An inner drive cylinder is configured on the inner cover plate set. The inner connecting plate is easily to be disassembled without other tools to assist when the inner connecting plate has to be replaced, so as to there is no tool damage the lock device and the door board.

1 Claim, 5 Drawing Sheets

LOCK DEVICE

BACKGROUND OF THE INVENTION

1. Field of the Invention

The invention relates in general to a lock device, and more particularly to a lock device having an inner connecting plate that is easily to be disassembled without other tools to assist and a new inner connecting plate is secured on a door board when the inner connecting plate has to be replaced, so that the lock device and the door board will not be damaged by the tools during disassembling the inner connecting plate.

2. Description of the Related Art

A conventional door lock includes an inner cover plate set and an inner connecting plate opposite to the inner cover plate set. A bottom of the inner cover plate set defines two opposite openings and a bottom face of the inner connecting plate defines two opposite raised dots correspond to the two openings on the inner cover plate set. To assemble the door lock on a door board, the inner cover plate set is firstly fixed on the door board. The inner connecting plate is further buckled to the inner cover plate set by inserting the raised dots into the openings. However, when disassembling the lock parts, a screwdriver is used along the door board to stretch inside the openings of the inner cover plate set to make the raised dots lifted off the openings.

With the conventional structure of the door lock, a gap between the opening and the raised dot may make the inner connecting plate slacken off. Hence the inner connecting plate is easily to shake or fall off when open and close the door frequently. Moreover, when disassembling the inner connecting plate, the screwdriver may scrape the door board.

SUMMARY OF THE INVENTION

An objective of the present invention is to provide a lock device that can replace an inner connecting plate easily without other tools to assist when the inner connecting plate has to be replaced, so that the tools will not scrape the lock device and the door board. According to a configuration of the lock device in accordance with the present invention, the inner connecting plate is stabled on the door board firmly.

In order to achieve the above-described objective, the lock device includes an external cylinder body, a latch unit, a screw part and an inner lock body that are combined together. The inner lock body is made up by an inner cover plate set, a washer plate, a spring, a spring plate, an inner connecting plate and an inner lever handle. A pair of opposite openings is located at a periphery of the inner cover plate set. An inner drive cylinder is configured on the inner cover plate set.

DETAILED DESCRIPTION OF THE INVENTION

Figure 1:
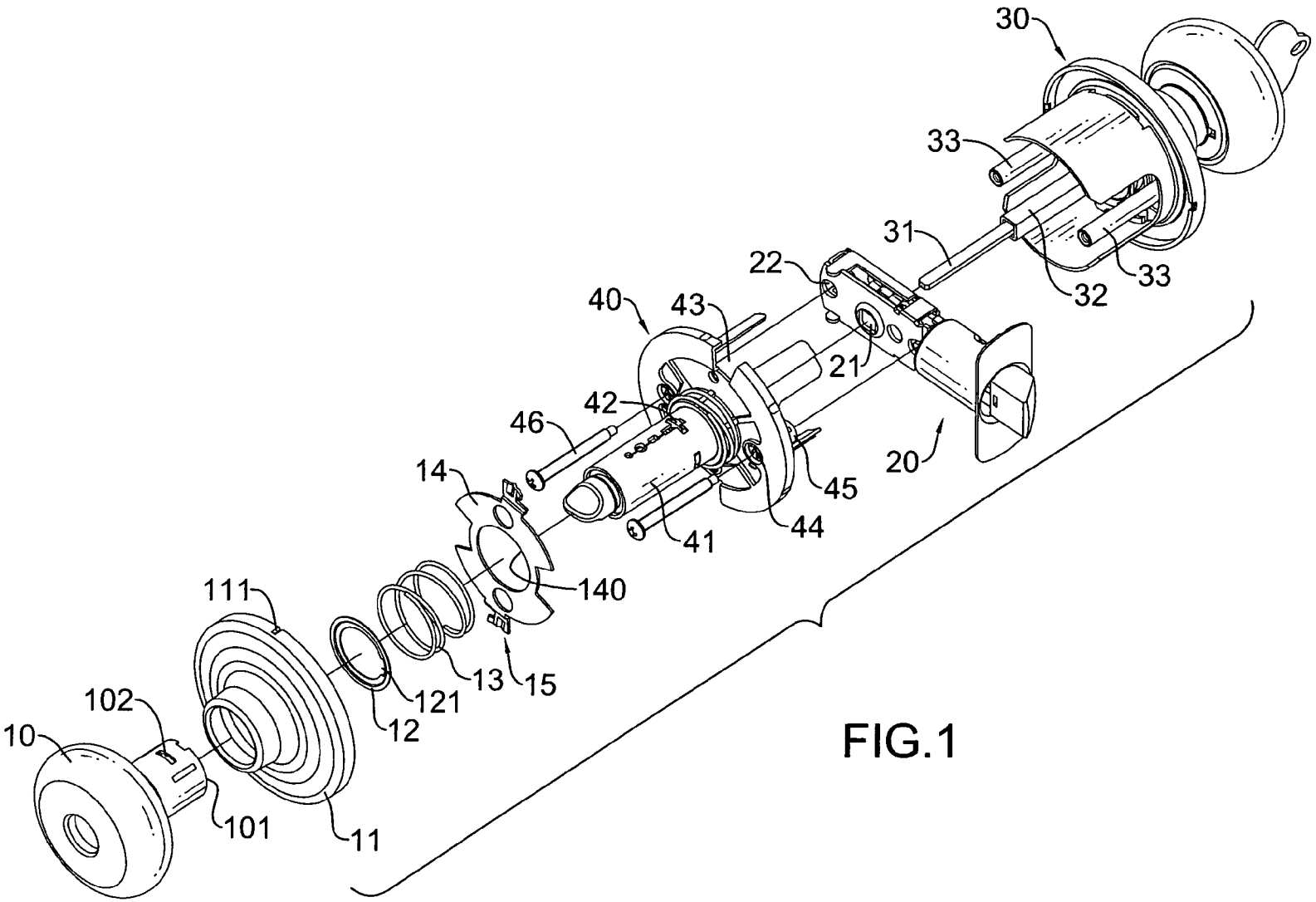
FIG. 1 is an exploded perspective view of a preferred embodiment of a lock device in accordance with the present invention.
Figure 5:
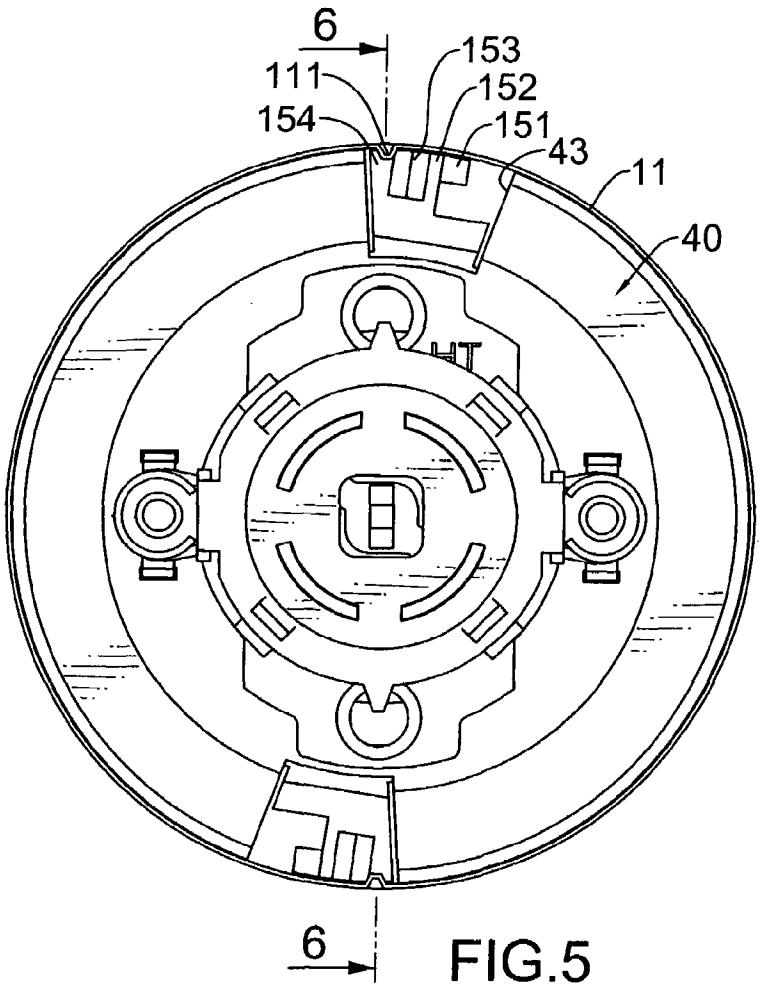
FIG. 5 is a side view of the inner connecting plate, which is assembled completely.

With reference to FIG. 1, a lock device of the present invention includes an external cylinder body 30, a latch unit 20, a screw 46 and an inner lock body as shown in FIG. 5 that are combined together. The inner lock body has an inner cover plate set 40, a washer plate 14, a spring 13, a spring plate 12, an inner connecting plate 11 and an inner lever handle 10.

A pair of opposite openings 43 is defined at a periphery of the inner cover plate set 40.

Figure 2:
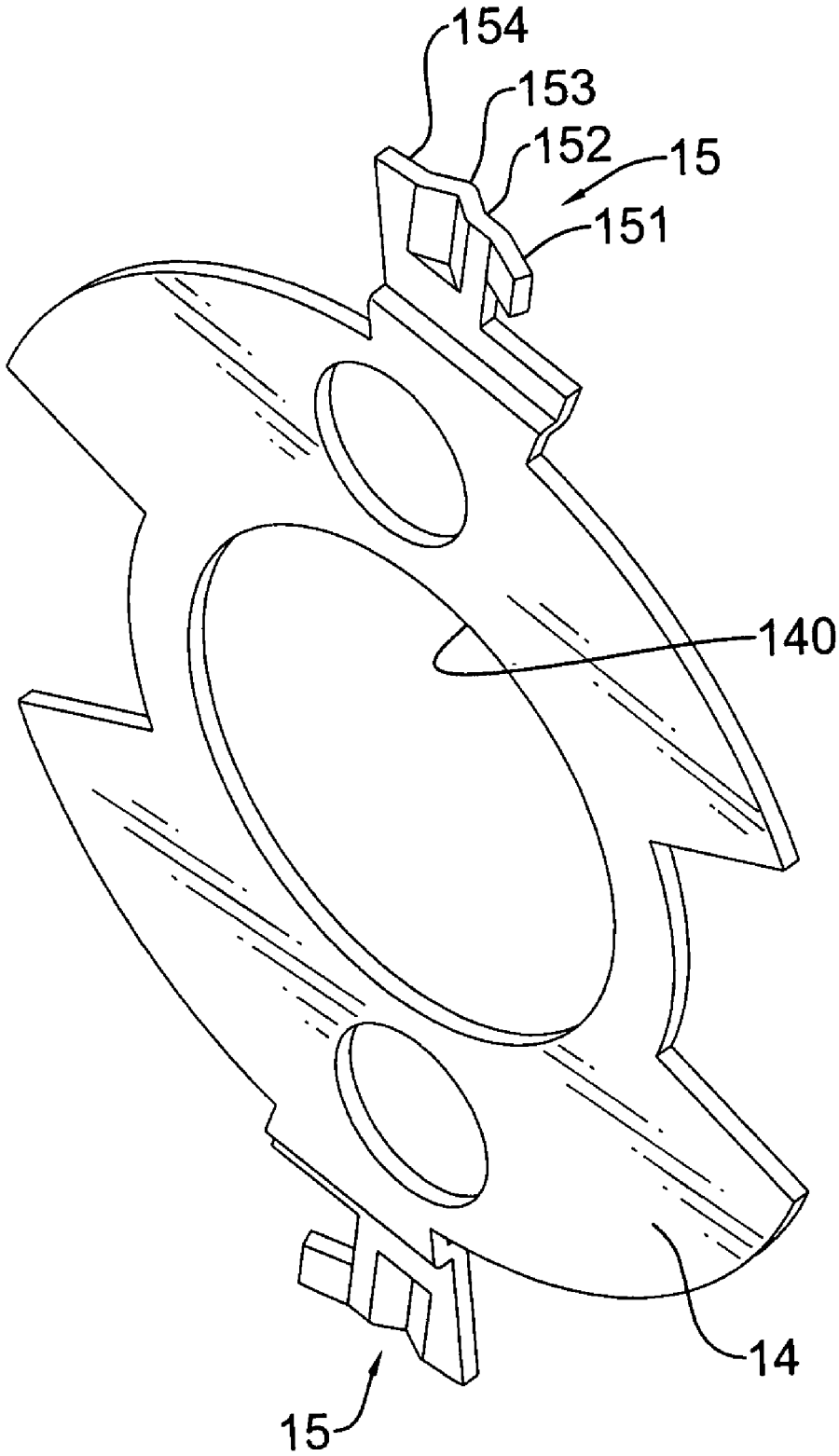
FIG. 2 is a perspective view of a washer plate in accordance with the present invention.

With further reference to FIG. 2, A periphery of the washer plate 14 outwardly forms a pair of opposite wave pawl parts 15. Each wave pawl part 15 is of an integral form having a raised part 151, a first flat part 152, a concave part 153 and a second flat part 154 that are crabwise and sequentially connected.

With reference to FIG. 1, when assembly, firstly the latch unit 20 is laterally inserted into a lock hole of a narrow side of a door board. Then the external cylinder body 30 is assembled outside of the door board. Two revolving rods 32 and two nut bolts 33 extended from the external cylinder body 30 respectively go through a corresponding revolving rod hole 21 and nut bolt hole 22 of the latch part 20. Therefore, the two revolving rods 32 and two nut bolts 33 are protruding inside of the door board. Then the inner cover plate set 40 is assembled inside of the door board by making a nut casing 45 mounted on the corresponding nut bolt 33. Two screws 46 are screwed inside two screw holes 44 of the inner cover plate set 40 to be tightened, so as to make the external cylinder body 30, the latch unit 20 and the inner cover plate set 40 securely fixed on the door board. At this moment, the wave pawl part 15 of the washer plate 14 faces the inner cover plate set 40 to go through an inner drive cylinder 41 of the inner cover plate set 40, so that the wave pawl parts 15 are aimed at the corresponding openings 43. In this way, each wave pawl part 15 is stuck with two sides of the corresponding opening 43 tightly. Therefore, the washer plate 14 on the inner cover plate set 40 is not turned. Since the raised part 151 is not against to the corresponding side of the opening 43, a gap is existed between the raised part 151 and the corresponding side of the opening 43.

The spring 13 is then put around outside of the inner drive cylinder 41. The spring plate 12 facing the inner cover plate set 40 is also putting around outside of the inner drive cylinder 41 to make a detent 121 of the spring plate 12 go through a protrusion 42, which is protruded an outside and close to an end of the inner drive cylinder 41. Then the detent 121 is rotated apart from the protrusion 42, so as to mount outside of the inner driver cylinder 41 and firmly hold the spring 13.

Figure 3:
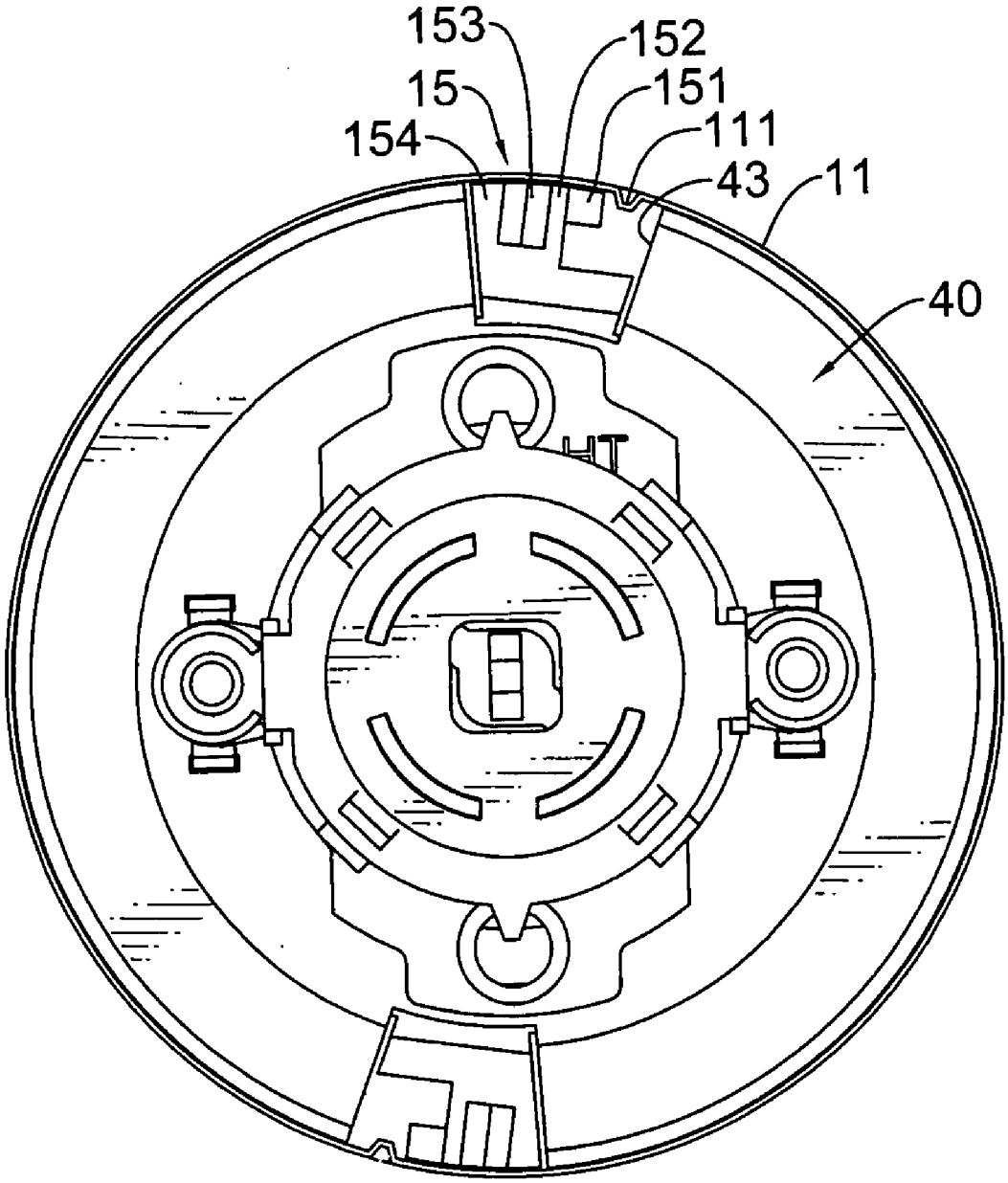
FIG. 3 is a side view of an inner connecting plate in an initial installation state in accordance with the present invention.
Figure 6:
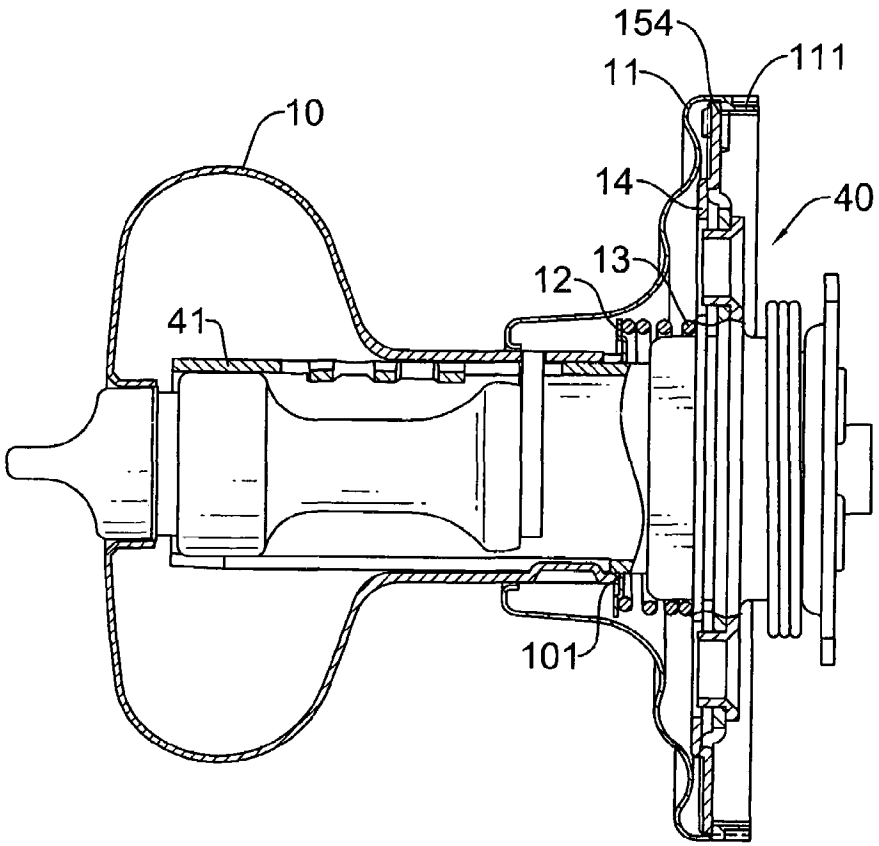
FIG. 6 is a longitudinal cross sectional view of FIG. 5 along a tangent line 6-6 in FIG. 5.

At this moment, with further reference to FIGS. 3, 5 and 6, the washer plate 14 is elastic mounted on the inner cover plate set 40 by the spring 13. Then the inner connecting plate 11 can be mounted on the inner drive cylinder 41. Two opposite raised dots 111 are configured at an internal side of a periphery of the inner connecting plate 11. Each raised dot 111 is then located at the corresponding gap between the raised part 151 and the corresponding side of the opening 43 of the inner cover plate set 40. Each raised dot 111 is behind the corresponding wave pawl parts 15.

Figure 4A:
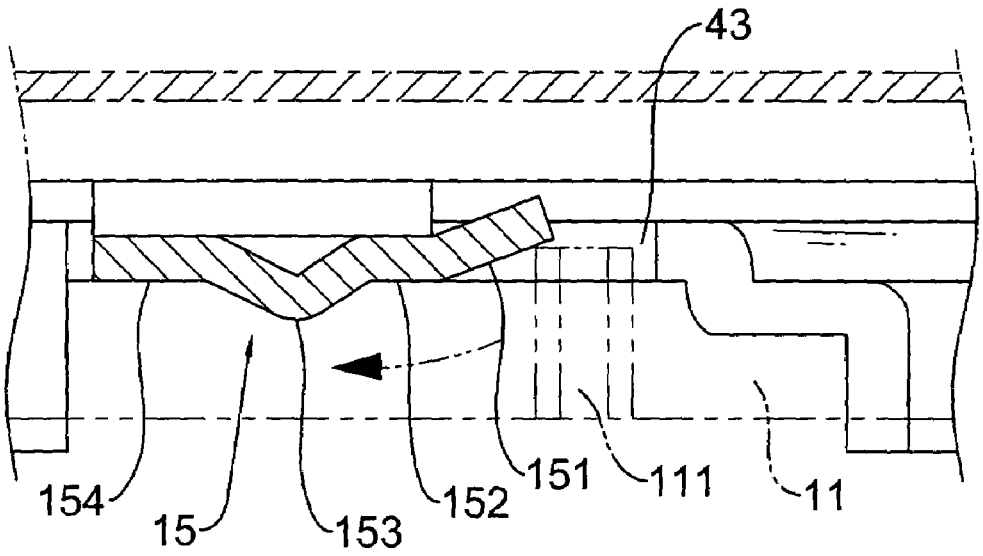
FIGS. 4A and 4B are operational cross sectional views in partial of the washer plate connected to the inner connecting plate in accordance with the present invention.
Figure 4B:
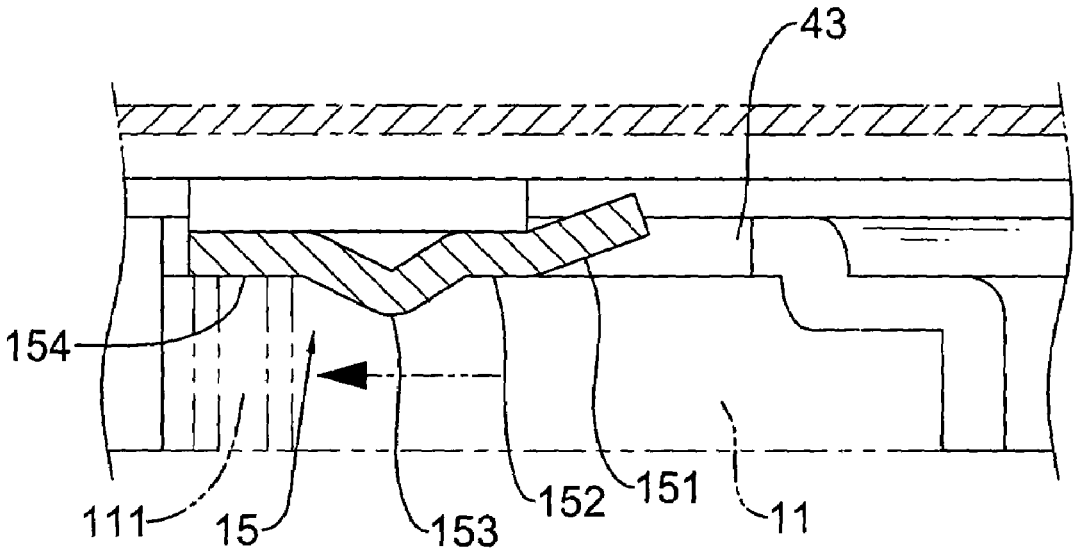

With further reference to FIG. 4A and FIG. 4B the inner connecting plate 11 is then rotated counterclockwise to make the raised dot 111 sequentially slip through the raised part 151, the first flat part 152 and the concave part 153. The raised dot 111 is finally located on the second flat part 154. At this moment, a bottom 101 of the inner lever handle 10 presses the spring plate 12, the spring 13 and the washer plate 14, and also to go through the second flat part 154 to elastically press the raised dot 111, so as to make the inner connecting plate 11 firmly stable on the door board.

Since the concave part 153 is located higher than the raised dot 111, when the spring 13 is pressed, the inner connecting plate 11 can be firmly stabled on an inside of the door board.

When the inner connecting plate 11 has to be replaced, the inner lever handle 10 can be disassembled first. Then the inner connecting plate 11 is rotated clockwise to make the raised dot 111 rotate to locate the gap between the raised part 151 and the corresponding opening 43 of the inner cover plate set 40. In this way, the inner connecting plate 11 can be taken out easily.

To sum up, with the foregoing described structural features and technique details, the lock device of the present invention can be clearly understood as follows.

The lock device of the present invention has the inner cover plate set to be stabled on the door board. The periphery of the inner cover plate set includes two openings located at both ends of the inner cover plate set. The washer plate is mounted on the inner cover plate set having the two ends of the wave pawl part stretching inside the openings of the inner cover plate set, so as to make the washer plated stuck.

The spring and the spring plate are mounted on the inner drive cylinder. The spring plate forms the detent to go through the protrusion of the inner drive cylinder. The spring plate can avoid to be pushed out of the drive cylinder by the spring by rotating the detent apart from the protrusion.

Then the inner connecting plate can be mounted on the inner drive cylinder. The raised dot configured at an internal side of a periphery of the inner connecting plate can be put at a gap between the wave pawl part and the openings of the inner cover plate set. Then the raised dot enters the second flat part via the raised part, the first flat part and the concave part of the wave pawl part by rotating the inner connecting plate. At this moment, the bottom of the inner lever handle presses the spring plate, the spring and the washer plate also to go through the second flat part to elastically press the raised dot, so as to make the inner connecting plate firmly stabled on the door board.

Since the concave part is located higher than the raised dot, when the spring is pressed, the inner connecting plate can be firmly stabled on the door board. When the inner connecting plate has to be replaced, the inner lever handle is disassembled first. Then the inner connecting plate is rotated to make the raised dot rotate to be departed from the wave pawl part. In this way, the inner connecting plate can be taken out to be replaced easily without other tools to assist. Hence the main structure of the lock device will not scrape the door board and also the inner connecting plate can be stabled on the door board firmly. Therefore the present invention of the lock device improves the convention lock, which indeed includes features of good utility and unobviousness to meet the requirements of a patent.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A lock device comprising an external cylinder body, a latch unit, a screw part and an inner lock body that are combined together, wherein the inner lock body has an inner cover plate set, a washer plate, a spring, a spring plate, an inner connecting plate and an inner lever handle, wherein a pair of opposite openings is located at a periphery of the inner cover plate set, wherein an inner drive cylinder is configured on the inner cover plate set, characterized in that:

a periphery of the washer plate forms two opposite wave pawl parts, and each of the two opposite wave pawl parts is of an integral form comprising a raised part, a first flat part, a concave part and a second flat part that are crabwise sequentially connected;

the washer plate is put around an outside of the inner drive cylinder of the inner cover plate set, so as to make the two opposite wave pawl parts respectively locate inside the corresponding opening of the inner cover plate set; and two opposite raised dots are configured at an internal side of a periphery of the inner connecting plate, and the inner connecting plate is put around the outside of the inner drive cylinder, so as to make the two opposite raised dot respectively locate at a gap between the corresponding wave pawl part and the corresponding opening of the inner cover plate set, wherein when inner connecting plate is rotated, the raised dot slips through the raised part, the first flat part and the concave part of the wave pawl part and then locates on the second flat part.

* * * * *